US008464799B2

(12) United States Patent
Scott et al.

(10) Patent No.: US 8,464,799 B2
(45) Date of Patent: Jun. 18, 2013

(54) CONTROL SYSTEM FOR A SURFACE CONTROLLED SUBSURFACE SAFETY VALVE

(75) Inventors: Bruce Edward Scott, Plano, TX (US); John Goiffon, Dallas, TX (US); Jimmie Robert Williamson, Jr., Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 220 days.

(21) Appl. No.: 12/696,834

(22) Filed: Jan. 29, 2010

(65) Prior Publication Data

US 2011/0186303 A1 Aug. 4, 2011

(51) Int. Cl.
*E21B 34/06* (2006.01)

(52) U.S. Cl.
USPC ..... 166/373; 166/66.7; 166/332.1; 166/332.8

(58) Field of Classification Search
USPC ..... 166/373, 386, 66.7, 332.1, 332.8
See application file for complete search history.

(56) References Cited

U.S. PATENT DOCUMENTS

| | | | | |
|---|---|---|---|---|
| 5,070,595 | A * | 12/1991 | Perkins et al. | 29/602.1 |
| 5,195,721 | A | 3/1993 | Akkerman | |
| 5,358,035 | A | 10/1994 | Grudzinski | |
| 5,518,462 | A | 5/1996 | Yach | |
| 5,865,272 | A | 2/1999 | Wiggins | |
| 5,915,668 | A | 6/1999 | Hodapp | |
| 5,984,260 | A | 11/1999 | Rawson | |
| 6,199,629 | B1 | 3/2001 | Shirk et al. | |
| 6,247,536 | B1 | 6/2001 | Leismer | |
| 6,464,011 | B2 | 10/2002 | Tubel | |
| 6,488,260 | B1 | 12/2002 | Dietz | |
| 6,585,228 | B1 | 7/2003 | McCaskill | |
| 6,619,388 | B2 | 9/2003 | Dietz | |
| 2006/0118304 | A1 * | 6/2006 | Ohmer | 166/301 |
| 2007/0295515 | A1 * | 12/2007 | Veneruso et al. | 166/386 |
| 2009/0020293 | A1 | 1/2009 | Richards | |
| 2010/0308240 | A1 | 12/2010 | McAdoo | |

OTHER PUBLICATIONS

ME90 Product Data Sheet "Model ME90 Fail-Safe Actuator," Cooper Cameron Corporation (2004).

* cited by examiner

*Primary Examiner* — Brad Harcourt
(74) *Attorney, Agent, or Firm* — Booth Albanesi Schroeder LLC

(57) ABSTRACT

Surface controlled subsurface control valves for use in wells and methods of controlling the same. In one embodiment, a valve includes a valve body, a bore closure assembly, a mechanical linkage, a drive assembly, and a control assembly. The valve body defines a bore for fluid to flow through when the bore closure assembly is in an open position. When the bore closure assembly is in its closed position, the bore closure assembly prevents fluid from flowing through the bore. The mechanical linkage is operatively connected to the bore closure assembly and to the drive assembly. The primary control assembly determines a force to apply to the mechanical linkage based on a present operating condition of the valve and causes the drive assembly to apply the determined force to the mechanical linkage. As a result, the mechanical linkage drives the bore closure assembly.

23 Claims, 7 Drawing Sheets

CONTROL SYSTEM FOR A SURFACE CONTROLLED SUBSURFACE SAFETY VALVE

FIELD OF INVENTION

The invention relates to an electrically operated surface controlled subsurface safety valves (SCSSV) for use in subterranean wells and, more particularly, to a downhole control and sensor system for use with a surface-controlled subsurface control valve.

BACKGROUND

The present invention relates generally to operations performed and equipment utilized in conjunction with a subterranean well and, in an embodiment described herein, more particularly provides an electrically operated deep set safety valve.

It is sometimes desirable to set a safety valve relatively deep in a well. For example, a safety valve may be set at a depth of 10,000 ft or more. However, operating a safety valve at such depths present a variety of problems which tend to be expensive to overcome. Most offshore hydrocarbon producing wells are required by law to include a surface controlled subsurface safety valve (SCSSV) located downhole in the production string to shut off the flow of hydrocarbons in an emergency. These SCSSV's are usually set below the mudline in offshore wells. Since offshore wells are being drilled at ever increasing water depths and in environmentally sensitive waters, it has become very desirable to electrically control these safety valves to eliminate the use of hydraulic fluids and be able to set the safety valves at virtually unlimited water depths. However, because of the depth, it is difficult to deliver the electric power to operate these valves. One or more wires can be run down the well to the valves, although the number is limited by space and design considerations. Moreover, a number of downhole tools, instruments, etc. compete for the limited amount of power available through the lines.

In addition, once a valve or other device is installed downhole it is difficult to remove and replace. Should it be desired to add or modify the functionality of the downhole components, it is difficult and expensive to effect the desired change.

Moreover, in a well environment, typical pressures, temperatures, salinity, pH levels, vibration levels, etc., downhole vary and are demanding. Moreover, the environment is often corrosive, including chemicals dissolved in, or otherwise carried by, the hydrocarbons or injected chemicals, such as hydrogen sulfide, carbon dioxide, etc. Thus, downhole components must be designed to withstand these conditions or isolated from the environment, such as by a sealed chamber.

SUMMARY

The following presents a simplified summary in order to provide a basic understanding of some aspects of the disclosed subject matter and does not limit the claimed invention. One embodiment provides a surface controlled subsurface control valve for use in a well. The valve includes a valve body, a bore closure assembly, a mechanical linkage, a drive assembly, and a downhole, local control assembly. The valve body defines a bore for fluid to flow through when the bore closure assembly is in an open position. When the bore closure assembly is in its closed position though, the bore closure assembly prevents fluid from flowing through the bore. The mechanical linkage is operatively connected to the bore closure assembly and to the drive assembly. The control assembly determines a force to apply to the mechanical linkage based on a present operating condition of the valve and causes the drive assembly to apply the determined force to the mechanical linkage. As a result, the mechanical linkage drives the bore closure assembly.

BRIEF DESCRIPTION OF THE DRAWINGS

The detailed description is described with reference to the accompanying figures. In the figures, the left-most digit(s) of a reference number generally identifies the figure in which the reference number first appears. The use of the same reference numbers in different figures typically indicates similar or identical items. The use of terms such as "up" and "down" are for point of reference and are not intended to limit the invention. The invention can be utilized in vertical, deviated and horizontal wellbores.

DETAILED DESCRIPTION

Described herein are systems and methods for controlling surface controlled subsurface safety valves (SCSSV). It is to be understood that the systems and methods can also be employed for the control of other surface controlled subsurface tools.

Figure 1:
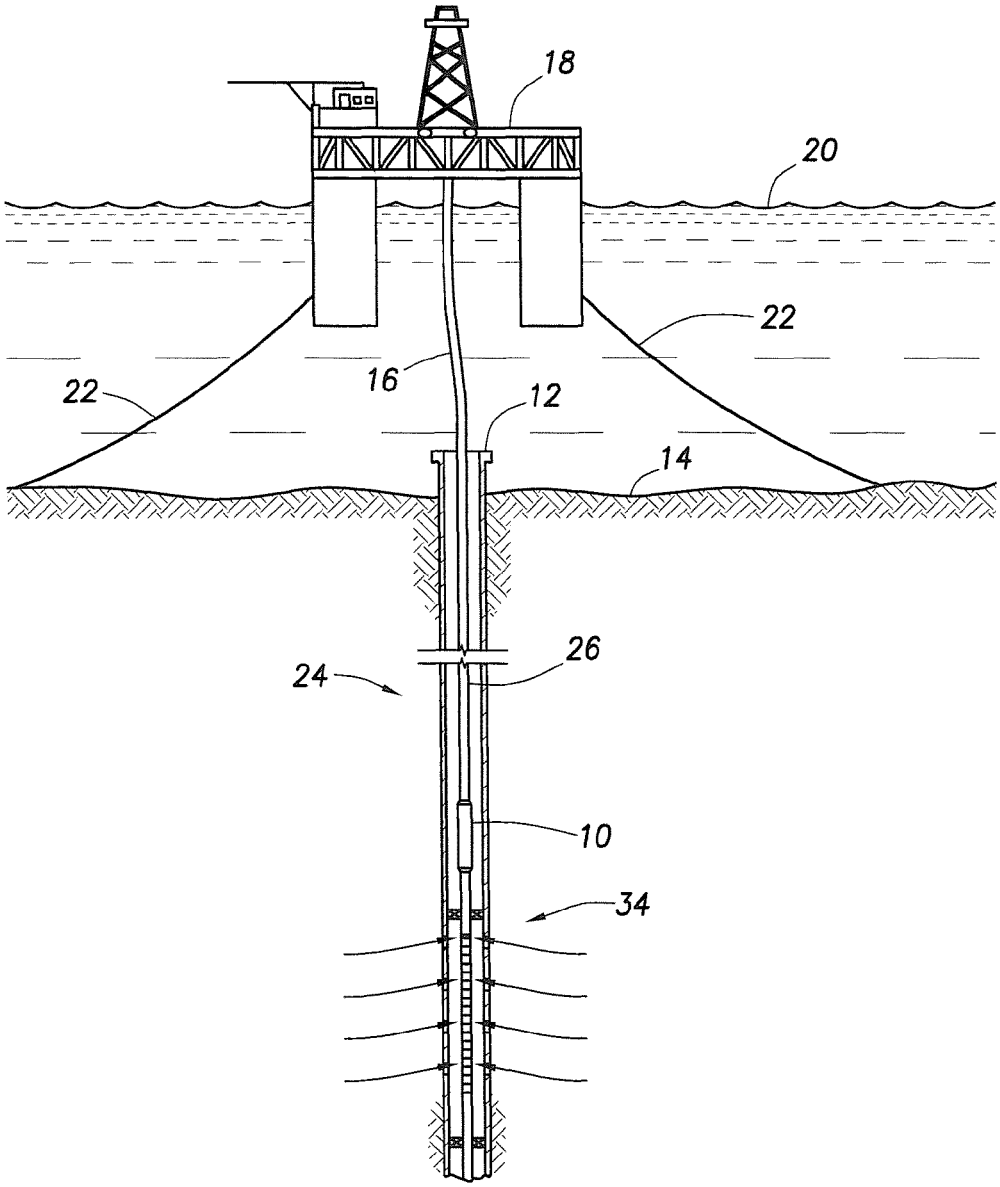
FIG. 1 shows a valve installed in an offshore hydrocarbon producing well
Figure 2:
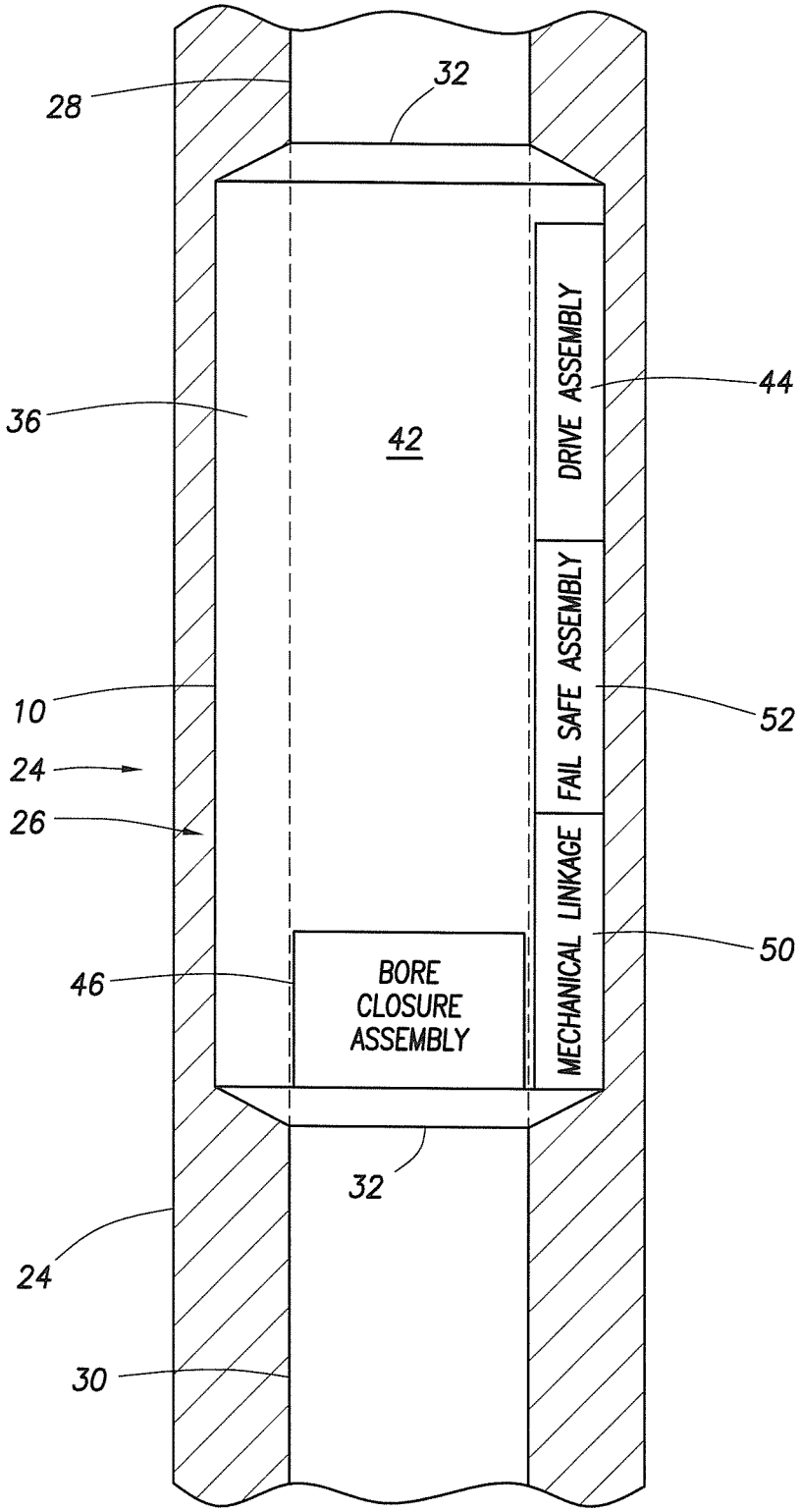
FIG. 2 is a cross-sectional view showing components of a valve installed in a well.

FIG. 1 shows a valve of the present invention installed in an offshore hydrocarbon producing well. In the embodiment of FIG. 1, a wellhead 12 rests on the ocean floor 14 and is connected by a flexible riser 16 to a production facility 18 floating on the ocean surface 20 and anchored to the ocean floor by tethers 22. A well production string 24 includes the flexible riser 16 and a downhole production string 26 positioned in the wellbore below the wellhead 12. The valve 10 is mounted in the downhole production string 26 below the wellhead. As shown in FIG. 2, the valve 10 is preferably mounted between an upper section 28 and a lower section 30 of the downhole production string 26 by threaded joints 32. The location that the valve 10 is mounted in the downhole production string 26 is usually dependent upon the particulars of a given well, but in general the valve 10 is mounted upstream from a hydrocarbon gathering zone 34 of the downhole production string 26, as shown in FIG. 1.

Figure 3:
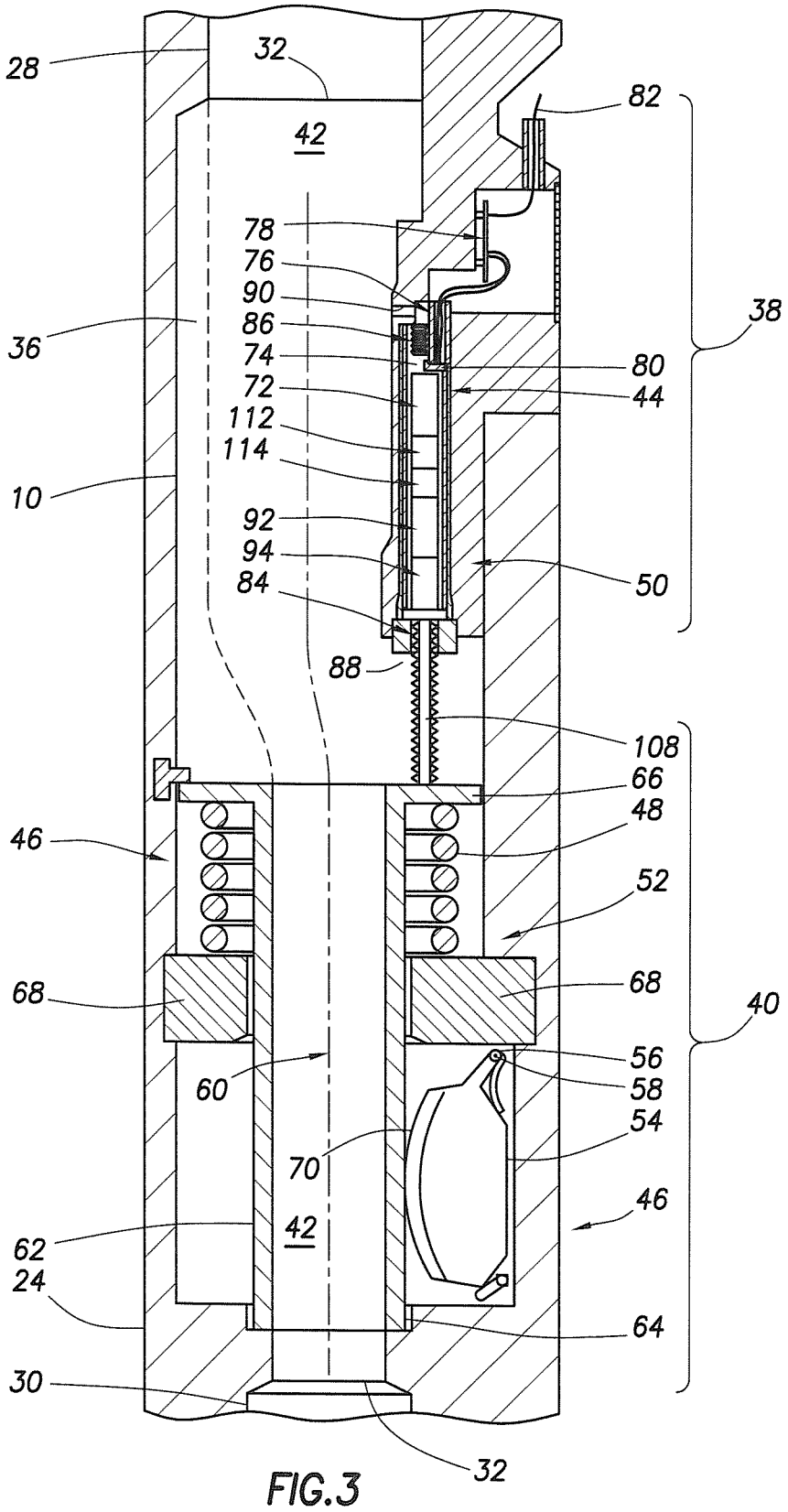
FIG. 3 is a cross-sectional view of an electro-mechanically actuated valve installed in a well.

Referring now to FIGS. 2 and 3, the valve 10 comprises a valve body 36 having an upper assembly 38, a lower assembly 40, and a longitudinal bore 42 extending through the length of the valve body 36. The longitudinal bore 42 forms a passageway for fluid to flow between the lower section 30 and the upper section 28 of the downhole production string 26. The valve 10 can further comprise a pressure balanced drive assembly 44 coupled to a bore closure assembly 46. As used herein, a pressure balanced drive 44 assembly means a drive configuration in which the driving force need only overcome the resistance force that normally biases the bore closure assembly 46 to a closed or other position (for instance, the force of spring 48 as illustrated in FIG. 3). The pressure balanced drive assembly 44 uses a mechanical linkage 50 to drive the bore closure assembly 46 to an open position in response to a control signal. A fail safe assembly 52 is positioned and configured to hold the bore closure assembly 46 in the open position while the control signal is being received and to release the bore closure assembly 46 to return to a closed position upon interruption of the control signal. A unique feature of the pressure balanced drive assembly 44 is that it need not overcome any additional force created by differential pressure or hydrostatic head of control fluid supplied from the surface. However, the drive assembly need not be a pressure balanced drive assembly 44.

While pressure balanced drive assembly 44, fail safe assembly 52, and mechanical linkage 50 are shown as separate components in FIG. 2, it should be understood that these three assemblies can be integrated into fewer than three components. For example a single drive/fail safe/linkage component or two components such as a drive/fail safe component coupled to a linkage component or a drive component coupled to a fail safe/linkage component could be included in these valves 10. In some embodiments, pressure balanced drive assembly 44, fail safe assembly 52, and mechanical linkage 50 are housed in the upper assembly 38 of valve 10 and the bore closure assembly 46 is housed in the lower assembly 40 of valve 10.

In the embodiment shown in FIG. 3, the bore closure assembly 46 is a flapper valve disposed within longitudinal bore 42 near the lower end of valve 10. However, other types of valves such as ball valves, gate valves, butterfly valves, etc. are within the scope of the disclosure. As its name implies, a flapper valve opens and closes the valve to fluid flow by rotation of a flapper 54 (FIG. 3) about a hinge 56 on an axis 58 transverse to an axis 60 of the longitudinal bore 42. The flapper 54 can be actuated by an axially movable flow tube 62 that moves longitudinally within the longitudinal bore 42. The lower end 64 of the flow tube abuts the flapper 54 and causes the flapper to rotate about its hinge 56 and open the valve 10 to fluid flow upon a downward movement by the flow tube 62. Compression spring 48, positioned between a flow tube ring 66 and a flapper seat 68, normally biases the flow tube 62 in the upward direction such that the lower end 64 of the flow tube in the closed position does not press downward upon the flapper 54. With the flow tube in a retracted position, the flapper 54 is free to rotate about axis 58 in response to a biasing force exerted by, for example, a torsion spring (not shown) positioned along axis 58 and applying a force to hinge 56. Flapper 54 can rotate about axis 58 such that the sealing surface 70 contacts the flapper seat 68, thereby sealing longitudinal bore 42 to fluid flow.

In another embodiment (not shown), the bore closure assembly 46 is a ball valve disposed within longitudinal bore 42 near the lower end of valve 10. Ball valves employ a rotatable spherical head or ball having a central flow passage which can be aligned with respect to the longitudinal bore 42 to open the valve 10 to fluid flow. Rotation of the ball valve through an angle of about 52 degrees or more will prevent flow through the longitudinal bore 42 of the ball valve, thereby closing the SCSSV to fluid flow. The ball valve can be biased to close the longitudinal bore 42 to fluid flow.

Conventionally, flapper and ball valves are actuated by an increase or decrease in the control fluid pressure in a separate control line extending from the valve to the ocean surface 20. As these valves are installed at deeper and deeper depths, the length of the control line increases, resulting in an increase in the pressure of the control fluid at the valve due to the hydrostatic head of the column of control fluid in the control line.

As a result of the higher pressure, problems can be encountered with hydraulic control signals from the surface. For instance, the lengthy control line can cause a delay in valve closure time and imposes extreme design criteria for these valves and associated equipment, both downhole and at the surface. Thus, in the embodiment illustrated by FIG. 2, a pressure balanced (also referred to as a pressure compensated) drive assembly 44 is used to actuate the bore closure assembly 46 in place of a hydraulic control signal from the surface.

Figure 4:
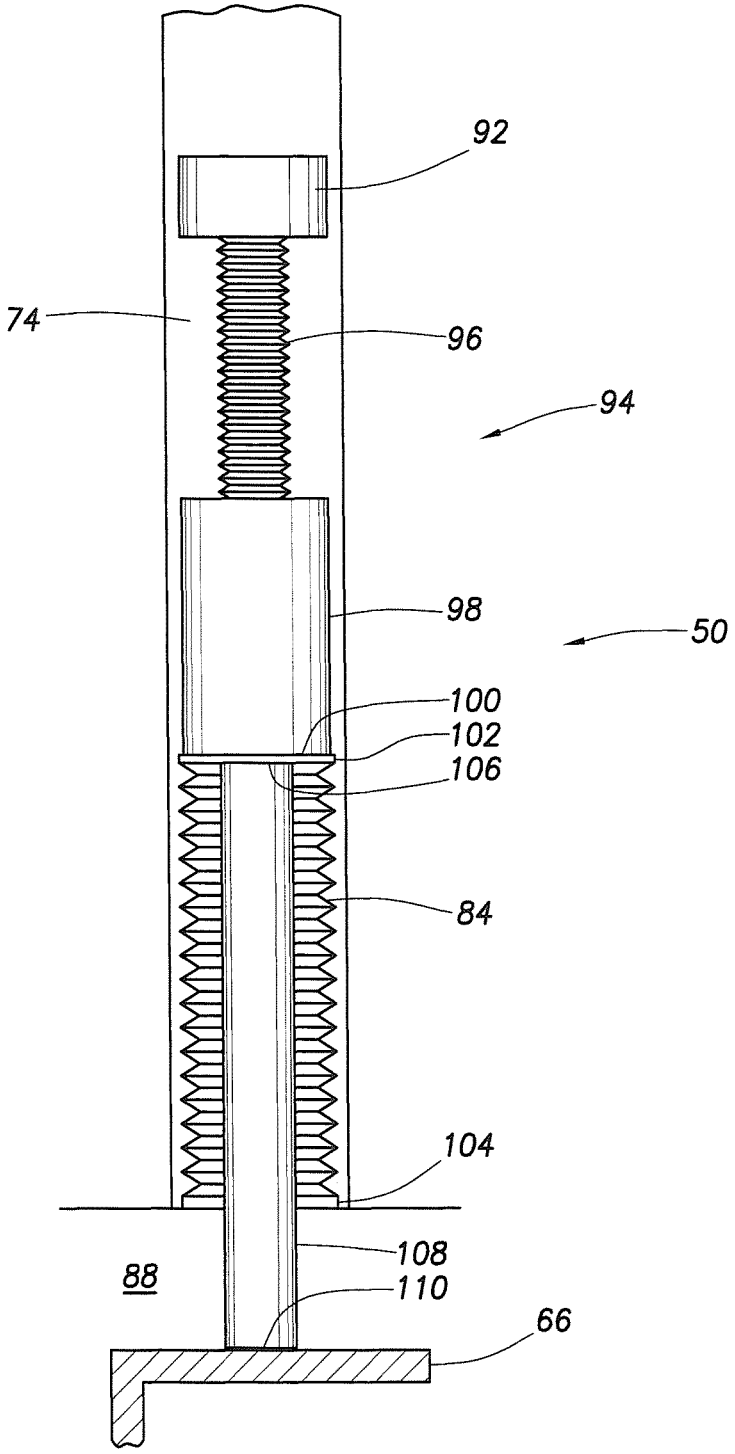
FIG. 4 is a close-up view of a ball screw assembly and bellows arrangement of a valve for use in a well.

Referring now to FIGS. 2-4, the pressure balanced drive assembly 44 comprises an actuator coupled by a mechanical linkage 50 to the bore closure assembly 46 for driving the bore closure assembly 46 to open the valve 10 (in response to an electronic control signal from the surface). The actuator may be an electric actuator such as a motor (AC or DC) or, more particularly, a stepper motor 72 (as illustrated by FIG. 3). In the embodiment shown in FIG. 3, the pressure balanced drive assembly 44 comprises the stepper motor 72 housed in a sealed chamber 74 filled with an incompressible fluid, for example dielectric liquids such as a perfluorinated liquid. The stepper motor 72 can be surrounded by a clean operating fluid and is separated from direct contact with the wellbore fluid. Other actuator motor types may be used, including but not limited to AC, DC, brushless, brushed, servo, stepper, coreless, linear, etc., as are known in the art.

In some embodiments, the stepper motor 72 is connected by a connector 76 to a local controller 78 such as a circuit board having a microcontroller and/or actuator control circuit. The local controller 78 can be housed in a separate control chamber that is not filled with fluid and that is separated from the sealed chamber 74 by high pressure seal 80. However the local controller 78 could be housed in the same fluid-filled chamber as the stepper motor 72 so long as the local controller 78 is designed to survive the operating conditions therein. The local controller 78 is capable of receiving control signals from the surface and sending data signals back to the surface, for example by an electrical wire 82 or by a wireless communicator (not shown). Where an electrical wire is used, the control signal is preferably a low power control signal that consumes less than about 12 watts to reduce the size of the wire used to transmit the signal across the potentially long distances associated with deep-set SCSSVs. Power to the stepper motor 72 may be supplied by direct electrical connection to the electrical wire 82 or through the wall of the sealed chamber 74 by an inductive source located outside of the sealed chamber 74 through use of inductive coupling.

The sealed chamber 74 further comprises a means for balancing the pressure of the incompressible fluid with the pressure of the wellbore fluid or wellbore annulus contained within the longitudinal bore 42. In a preferred embodiment, bellows 84 and 86 are used to balance the pressure of the incompressible fluid in the sealed chamber 74 with the pressure of the wellbore fluid. One of the bellows 84 is in fluid communication with the chamber fluid and the wellbore fluid 88. Bellows 86 is in fluid communication with the chamber fluid and the wellbore fluid 88 as shown by passage 90. Some embodiments in which bellows 84 is a sealing bellows and bellows 86 is a compensation bellows are disclosed in International Application No. PCT/EPOO/01552 with an international filing date of Feb. 16, 2000 and International Publication No. WO 00/53890 with an international publication date of Sep. 14, 2000 (which are incorporated by reference herein in their entirety for all purposes). While this description focuses on a bellows, it should be understood by those of skill in the art that other embodiments are available for use including, by way of example and not limitation, one or more balance pistons or fluid reservoirs. Fluid reservoirs can take any known form, such as tanks, a length of tubing, an annular cavity, etc.

In the current embodiment, a mechanical linkage 50 is used by the pressure balanced drive assembly 44 to exert an actuating force on the bore closure assembly 46 to open the valve 10 to fluid flow. The mechanical linkage 50 may be any combination or configuration of components suitable to achieve the desired actuation of the bore closure assembly 46. In the embodiment illustrated by FIG. 3, the mechanical linkage 50 comprises a gear reducer 92 and a ball screw assembly 94, or alternatively a roller screw assembly in place of the ball screw assembly.

FIG. 4 shows a mechanical linkage 50 which includes a ball screw assembly 94 and bellows arrangement for a valve 10. The ball screw assembly 94 further comprises a ball screw 96, the upper end of which is connected to the gear reducer 92 and the lower end of which is threaded into a drive nut 98. The gear reducer 92 serves to multiply the torque of the stepper motor 72 delivered to the ball screw assembly 94. More than one gear reducer 92 can be employed along the drive line between the motor 72 and the ball screw assembly 94. The lower end 100 of the drive nut 98 contacts the end face 102 of the bellows 84. The bellows 84 is fixedly connected at the edge 104 of the sealed chamber 74 and is arranged to expand or contract upward from edge 104 and into the sealed chamber 74. The lower side of end face 102 of the bellows 84 is in contact with the upper end 106 of power rod 108 which is exposed to the wellbore fluid 88. The lower end 110 of power rod 108 is in contact with and is fixedly connected to the flow tube ring 66. The drive nut 98 is restrained from rotating, and in response to rotation of the ball screw 96 by the gear reducer 92, travels axially thereby moving the power rod 108 and the flow tube ring 66 downward to open the valve 10 to fluid flow. Alternatively, the drive nut 98 can be rotated while the ball screw 96 is held from rotating thereby causing relative motion between these components to actuate the flow tube 62.

Alternatively, as shown in FIG. 3, the bellows 84 may be arranged to expand or contract downward from the sealed chamber 74 rather than upward into the sealed chamber 74. In the embodiment of FIG. 3, the upper end of the power rod 108 is in contact with, and is fixedly connected to, the lower end of the drive nut 98. Moreover, in the current embodiment, the lower end of power rod 108 is in contact with the upper side of the end face of the bellows 84 (which is in contact with the flow tube ring 66).

Referring again to FIG. 2, the fail safe assembly 52 is positioned and configured to hold the bore closure assembly 46 in the open position (commonly referred to as the "fully open" position) while the control signal is being received. Moreover the fail safe assembly 52 is configured to release the bore closure assembly 46 to return to the closed position upon interruption of the control signal, which is also referred to as a "hold" signal. The hold signal is communicated through a wire or by wireless communication from a control center located at the surface. In the event that the hold signal is interrupted (resulting in the fail safe assembly 52 no longer receiving the hold signal), the fail safe assembly 52 releases the bore closure assembly 46 to automatically return to the closed position. In other words, the valve 10 of the current embodiment is a fail-safe valve.

The hold signal might be interrupted, for example, unintentionally by an event along the riser, wellhead, or production facility, or intentionally by a production operator seeking to shut-in the well in response to particular operating conditions or desires (such as maintenance, testing, production scheduling, etc.). In effect, the pressure balanced drive assembly 44 is what "cocks" or "arms" the valve 10 by driving the valve 10 from its normally biased closed position the open position. The fail safe assembly 52 therefore serves as a "trigger" by holding the valve 10 in the open position during normal operating conditions in response to a hold signal. Interruption or failure of the hold signal causes the valve 10 to automatically "fire" closed.

In the embodiment illustrated by FIG. 3, the fail safe assembly 52 comprises an anti-backdrive device 112 and an electromagnetic clutch 114. The fail safe assembly 52 can be configured such that electromagnetic clutch 114 is positioned between the anti-backdrive device 112 (which is connected to the stepper motor 72) and the gear reducer 92 (which is connected to the ball screw assembly 94), provided, however, that the individual components of the fail safe assembly 52 may be placed in any operable arrangement. For example, the electromagnetic clutch 114 may be positioned between the gear reducer 92 and the ball screw assembly 94. Alternatively, the electromagnetic clutch 114 may be interposed between gear reducer sets. When engaged, the electromagnetic clutch 114 serves as part of a coupling for the stepper motor 72 to drive the ball screw assembly 94. Conversely, when the electromagnetic clutch 114 is disengaged, the stepper motor 72 is mechanically isolated from the ball screw assembly 94. The local controller 78 engages the electromagnetic clutch 114 by applying an electrical current to the electromagnetic clutch 114 and disengages the electromagnetic clutch by removing the electrical current to it.

In response to a control signal to open the valve 10, the stepper motor 72 is powered and the electromagnetic clutch 114 is engaged to drive the ball screw assembly 94, thereby forcing the flow tube 62 downward against the flapper 54 and opening the valve 10 to fluid flow. The stepper motor 72 drives the bore closure assembly 46 to the open position, as sensed and communicated to the drive assembly (i.e., stepper motor 72) by a means for sensing and communicating the position of the bore closure assembly 46. An example of a suitable means for sensing and communicating the position of the bore closure assembly 46 is a feedback loop sensing the position of the bore closure assembly 46 (or the location of the flow tube 62, flapper 54, or ball nut of the ball screw assembly 94) and communicating that position to the local controller 78.

As illustrated in FIG. 3, the anti-backdrive device 112 prevents the ball screw assembly 94 from reversing. A preferred anti-backdrive device 112 conveys a rotational force in only one direction. Thus, in some embodiments, the anti-backdrive device 112 includes a sprag clutch. In response to rotation by the stepper motor 72, the sprag clutch freewheels and remains disengaged. Conversely, in response to a reversal or backdrive force transmitted by the spring 48 through the ball screw assembly 94, cogs in the sprag clutch engage, thereby preventing counter rotation and locking the bore closure assembly 46 in the open position. In the alternative, or in addition, the anti-backdrive devices 112 can include a non-back driveable gear reducer, an electromagnetic brake, a spring-set brake, a permanent magnet brake on the stepper motor 72, a means for holding power on the stepper motor 72 (i.e., "locking the rotor" of the electric motor), a locking member, a piezoelectric device, a magneto-rheological (MR) device, etc. Commonly owned U.S. Pat. No. 6,619,388 entitled "Fail Safe Surface Controlled Subsurface Safety Valve For Use in a Well," by Dietz et al., and issued on Sep. 16, 2003 (which is incorporated herein by reference for all purposes) illustrates embodiments of anti-backdrive devices 112.

Regardless of its form, the anti-backdrive device 112 holds the bore closure assembly 46 in the open position so long as electromagnetic clutch 114 remains engaged. In the current embodiment, the hold signal is the electric current powering the electromagnetic clutch 114 to engage. As described previously, the hold signal can be interrupted either intentionally (for example, by a person signaling the local controller to close the valve) or unintentionally (for example, due to a power or communication interruption). Upon interruption of the hold signal, the electromagnetic clutch 114 of the current embodiment disengages, allowing the ball screw assembly 94 to reverse, the flow tube 62 to move upward in response to the biasing force of the spring 48, and the flapper 54 to rotate closed about the axis 58. Thus, the electromagnetic clutch 114 isolates the stepper motor 72 from reversal or backdrive forces transmitted through the mechanical linkage 50, thereby preventing damage to stepper motor 72 and other components and facilitating quick closure of the valve 10 (in some embodiments, closure occurs within less than about 5 seconds).

Figure 5:
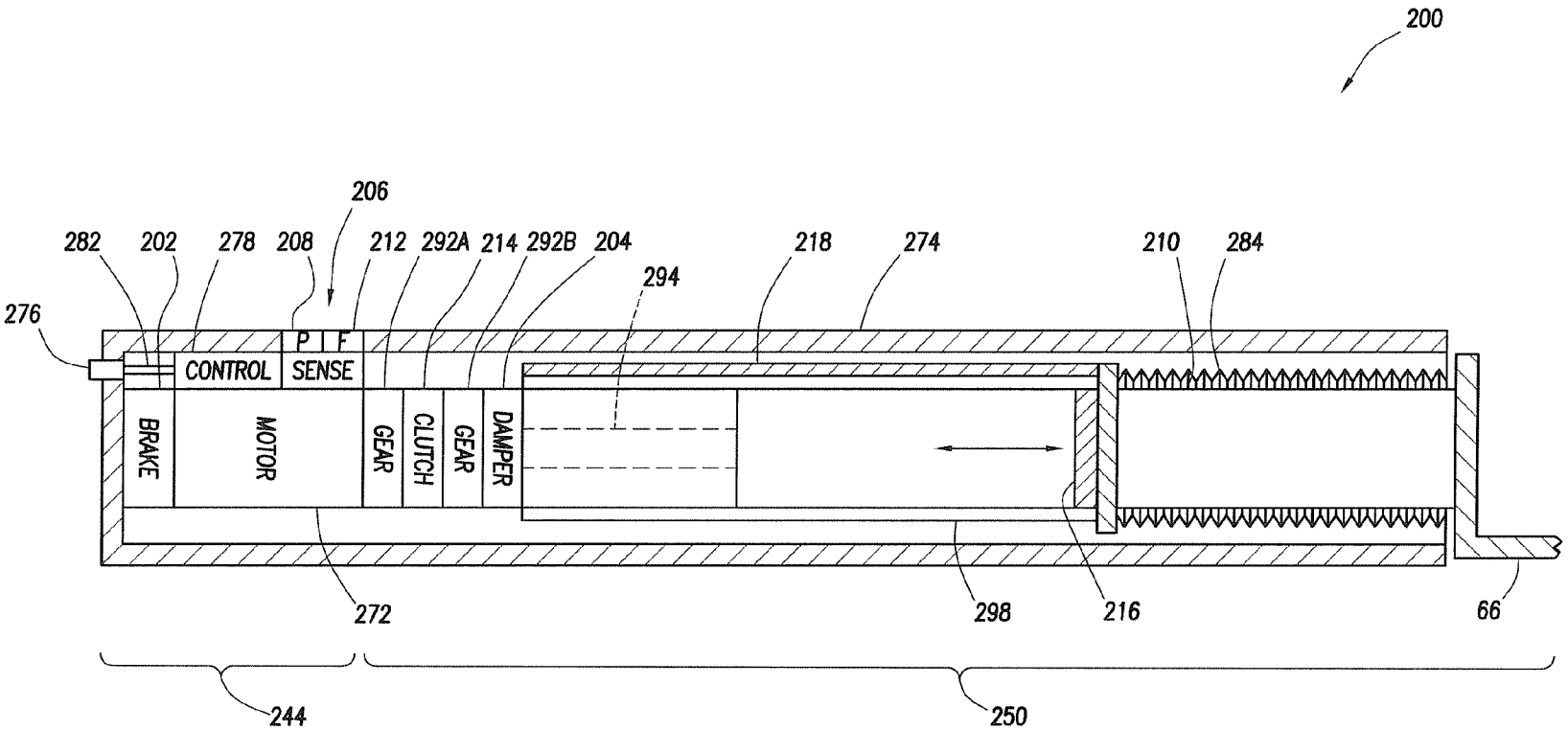
FIG. 5 is a cross-sectional view of an electric valve actuator for use in a well.

With reference now to FIG. 5, the drawing is a cross-sectional view of an electric valve actuator for use in a well. The actuator 200 includes a power rod 210, an electromagnetic clutch 214, a drive assembly 244, a mechanical linkage 250, a stepper motor 272, a sealed chamber 274, a connector 276, a local controller 278, an electrical wire 282, a bellows 284, gear reducers 292, a ball screw assembly 294, and a drive nut 298. The actuator 200 also includes a sensing assembly 206 which includes a plurality of sensors such as a pressure sensor 208, flow rate sensor 212, a load sensing assembly 216, and a position sensor 218. Other sensors are known in the art and can be employed. The actuator 200 can receive electric power and control signals via the connector 276 and wire 282. Moreover, the actuator 200 drives the flow ring tube 66 via power rod 210 to open, close, or otherwise position the bore closure assembly 46 (see FIGS. 2 and 3).

In the alternative, or in addition, the actuator 200 can derive power locally as disclosed in commonly owned U.S. Pat. No. 6,717,283, issued to Skinner et al. on Apr. 6, 2004, and entitled "Annulus Pressure Operated Electric Power Generator"; U.S. Pat. No. 6,848,503, issued to Schultz et al. on Feb. 1, 2005, and entitled "Wellbore Power Generating System For Downhole Operation"; U.S. Pat. No. 6,672,382, issued to Schultz et al. on Jan. 6, 2004, and entitled "Downhole Electrical Power System"; U.S. Pat. No. 7,165,608, issued to Schultz et al. on Jan. 23, 2007, and entitled "Wellbore Power Generating System For Downhole Operation"; or United States Patent Publication No. 20060191681, filed by Storm et al. on Aug. 31, 2006, and entitled "Rechargeable Energy Storage Device In A Downhole Operation" each of which are incorporated herein by reference for all purposes.

Generally, the various components of the actuator 200 are housed in the sealed chamber 274 and/or the bellows 284 to isolate them from the downhole environment and to render the actuator 200 "pressure balanced". However, the connector 276, the pressure sensor 208 and flow rate sensor 212 can penetrate the sealed chamber 275 to, respectively, communicate electrical signals, sense a pressure in the downhole environment, and sense the flow rate of the hydrocarbons, drilling fluid, etc. in the downhole environment.

Mechanically, the components of the actuator 200 may be operatively connected as shown in FIG. 5 to position the bore closure assembly 46. More particularly, the drive assembly 244 can be operatively connected to the mechanical linkage 250 and can drive the same in a bi-directional fashion. In addition, the mechanical linkage 250 can be operatively connected to the flow tube ring 66 so that it can open, close, and incrementally position the bore closure assembly 46 (see FIGS. 2 and 3).

The drive assembly 244 can include the brake 208 and the stepper motor 272 while the mechanical linkage 250 can include the gear reducers 292, the electromagnetic clutch 214, the damper 204, the ball screw 294, the ball nut 298, and the power rod 210. Depending on operating conditions of the valve (in which the actuator 200 is installed) it might be the case that the bore closure assembly 46 back drives, or attempts to back drive, the mechanical linkage 250 and thus the drive assembly 244. Since stepper motors 272 typically resist forces that attempt to back drive them, the actuator 200 is not prone to being damaged by being back driven. However, the gear reducers 292 provide resistance to such back driving forces depending on their gear ratios. In addition, the electromagnetic clutch 214 (when disengaged) provides another level of protection against back driving the stepper motor 272.

With continuing reference to FIG. 5, the brake 202 and stepper motor 272 can be positioned at one end of the actuator 200 and operatively connected so that when a signal is applied to (or removed from) the brake 202, it slows and/or stops the electric motor 272. The stepper motor 272 can be operatively connected to one of the gear reducers 292A, which in turn is operatively connected to the driven side of the electromagnetic clutch 214. Another gear reducer 292B can be operatively connected to the driving side of the electromagnetic clutch 214. Thus, when the electromagnetic clutch 214 is engaged and the stepper motor 272 rotates, the gear reducer 292B also rotates albeit at a rate determined by the gear ratios of the gear reducers 292. However, when the electromagnetic clutch 214 is disengaged, the stepper motor 272 and the gear reducer 292B are mechanically isolated from one another.

Furthermore, the damper 204 can be operatively connected to the output side of the gear reducer 292B and to the ball screw 294. Thus, the damper 204 can isolate the stepper motor 272, gear reducers 292, and electromagnetic clutch 214 from vibrations, shocks and excessive rotational speeds originating elsewhere in the mechanical linkage 250 and bore closure assembly 46 and vice versa.

Still with reference to FIG. 5, the ball screw 294 and ball nut 298 can slidably engage one another such that, if one or the other is fixed against rotation, they translate relative to one another when the stepper motor 272 drives the ball screw 298 via the aforementioned components. Furthermore, the ball nut 298 and the power rod 210 can abut the bellows 284 on opposite sides of the same. More particularly, in embodiments in which it is desired to allow the stepper motor 272 to drive the bore closure assembly 246 bi-directionally, the ball nut 298 and the power rod 210 can mechanically connect to a portion of the bellows 284 shaped and dimensioned to convey loads between these two components. As a result, when the stepper motor 272 rotates, the ball nut 298 drives the power rod 210, which pushes or pulls on the flow tube ring 66. Alternatively, or in addition, if the bore closure assembly 46 is biased to one or another position, the bore closure can back drive (in either direction) the mechanical linkage 250 and/or the drive assembly 244 as determined by the configuration of the gear reducers 292, the electromagnetic clutch 214, the brake 202, etc.

As illustrated by FIG. 5, a load sensing assembly 216 can also be included in either the drive assembly 244 and/or the mechanical linkage 250. For instance, the load sensing assembly 216 can be positioned between the ball nut 298 and the bellows 284 and within the sealed chamber 274. In the current embodiment, the load sensing assembly 216 includes a load cell which senses the force developed between the ball nut 298 and the bellows 284 as the stepper motor 272 operates or even during quiescent times. In the alternative, or in addition, the load sensing assembly 216 could be located and configured to sense torque developed between the various rotating components of the drive assembly 244 and/or the mechanical linkage 250. Regardless of the location of the load sensing assembly 216, it can (by way of sensing the loads between the various components) sense resistance to the operation of the stepper motor 272 that might develop in the drive assembly 244, the mechanical linkage 250, and other components of the valve 10 (for instance the flow tube ring 66 and bore closure assembly 46).

Further, the load sensing assembly can be an electrical load sensor assembly for sensing the electrical load, impedance, or power consumed by a circuit. Such a load sensor can be utilized to sense the electrical load, its variance over time, and its response as power is supplied to the stepper motor, or other valve parts.

In some embodiments, the position sensor 218 can be located to sense the position of the bore closure assembly 46 either directly or indirectly (i.e., through a position associated with the mechanical linkage 250). For instance, the position sensor 218 can extend along a portion of the sealed chamber 274 defined by the stroke of the drive nut 298. The position sensor 218 could be an inductive (Hall Effect), a potentiometer, or some other type of sensor. In the alternative, or in addition, the position sensor 218 could be an encoder built into or operatively connected to the stepper motor 272 or some other rotating component of the drive assembly 244 or mechanical linkage 250.

FIG. 5 shows that the sensing assembly 206 can include a number of sensors such as the pressure sensor 208, the flow rate sensor 212, an electric current sensor, a voltage sensor, etc. along with signal conditioners, amplifiers, and other components. While FIG. 5 illustrates the load sensing assembly 216 and the position sensor 218 being physically separate from the sensing assembly 206, the sensing assembly 206 can include the load sensing assembly 216 and the position sensor 218. In the alternative, the various sensors 208, 212, 216, and 218 (as well as others) can be physically separate from, but in electrical communication with, the signal conditioners, amplifiers, and other components of the sensing assembly 206. Depending on the user's needs, the local controller 278 can be configured to sense one or more of the signals from the foregoing sensors and to operate the valve 10 in a closed loop mode with respect to the sensed signal(s). Thus, valves of various embodiments operate as pressure control valves, flow control valves, and the like.

Figure 6:
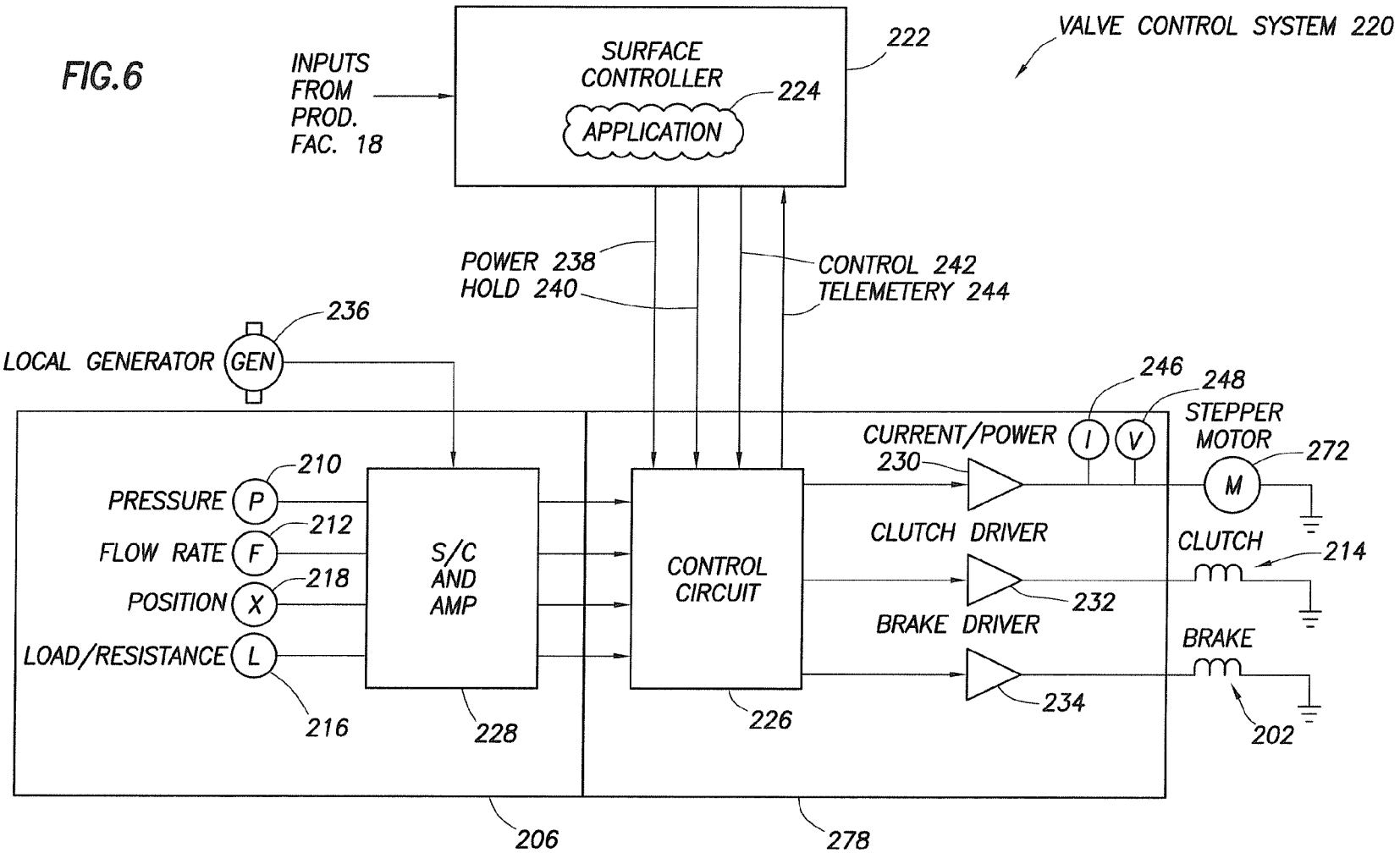
FIG. 6 is a block diagram of a control system for a valve for use in a well.

FIG. 6 is a block diagram of a control system for a valve 10 for use in a well. In addition to several of the aforementioned components (the brake 202, sensing assembly 206, pressure sensor 210, flow rate sensor 212, electromagnetic clutch 214, load sensing assembly 216, position sensor 218, stepper motor 272, and local controller 278), FIG. 6 illustrates that the control system 220 includes a surface controller 222, a software program or an application 224, a control circuit 226, a signal conditioner 228, a current/power amplifier 230, a clutch driver 232, a brake driver 234, a local generator 236, a source of surface power 238, and communication paths for hold signal 240, one or more control signals 242, one or more telemetry signals 244. In addition, the control system 220 can include various current sensors 246, and various voltage sensors 248.

With continuing reference to FIG. 6, the sensing assembly 206 is located in or on the valve 10. The sensing assembly 206 either includes or is operatively connected to the various sensors including the pressure sensor 210, the flow rate sensor 212, the load sensing assembly 216, and the position sensor 218. Moreover, the sensing assembly 206 includes the signal conditioner 228 (which can include amplifiers and other components). Moreover, the signal conditioner 228 receives signals from the sensors, conditions the signals, and communicates them to the local controller 278.

Still referring to FIG. 6, the local controller 278 performs a number of functions. For instance, the control circuit 226 therein receives the conditioned signals from the signal conditioner 228 which convey the pressure, the flow rate, the bore closure assembly position, the load or resistance to the operation of the stepper motor 272 (as sensed by load sensing assembly 216) and other present operating conditions of the valve 10. Moreover, the control circuit 226 receives the hold signal 240 and other control signals 242 from the surface controller 222. It also emits telemetry signals 244 to the surface controller 222. While FIG. 6 illustrates separate signals for the surface power 238, the hold signal 240, the control signals 242, and the telemetry signals 244, it is understood that these signals can be conveyed along a single wire (see wire 282 of FIG. 3), a communications bus, or via a wireless or other communications link without departing from the scope of the disclosure.

In addition, in response to the present operating conditions associated with the valve 10, the control circuit 226 generates control signals, which it transmits to the current/power amplifier 230, the clutch driver 232, and the brake driver 234. For instance, in some situations, the control circuit 226 might position the bore closure assembly 46 via the current/power amplifier 230, engage or disengage the clutch 214 via the clutch driver 232, and/or apply or release the brake 202 via the brake driver 234. The local controller 278 (or even the surface controller 222) can also determine how much force to apply via the stepper motor 272 to position the bore closure assembly 46, the rate of that positioning, and can vary related parameters and aspects of the valve 10 as well.

The control circuit 226 and other components of the sensing assembly 206 and local controller 278 can be integrated on an IC (integrated circuit) chip, an ASIC (Application Specific Integrated Circuit), or can be implemented in analog circuitry. In the alternative, or in addition, these components can be implemented in firmware or software run on a processor and stored in a memory. The control circuit 226 can host software applications designed to control operation and monitoring of the valve or its components or of the environment.

Still with reference to FIG. 6, the surface controller 222 typically hosts a software application 224, which is configured to assist in controlling the valve 10. However, the surface controller 222 could be implemented in firmware or analog or digital circuitry as indicated above with reference to the control circuit 226. Moreover, the surface controller 222 performs numerous functions for controlling the valve 10. For instance, it receives inputs from various users and software applications, circuits, and sensors associated with the production facility 18. From this information, and from the telemetry signals 244 from the local controller 278, the surface controller 222 applies/removes surface power 238 from the valve 10, applies/removes the hold signal 238 from the same, and can generate commands to position the bore closure assembly 46 and to operate the electromagnetic clutch 214 and the brake 202. In operation, valves of various embodiments as illustrated by FIGS. 1-6 can be monitored and controlled as illustrated by the flowchart of FIG. 7.

Figure 7:
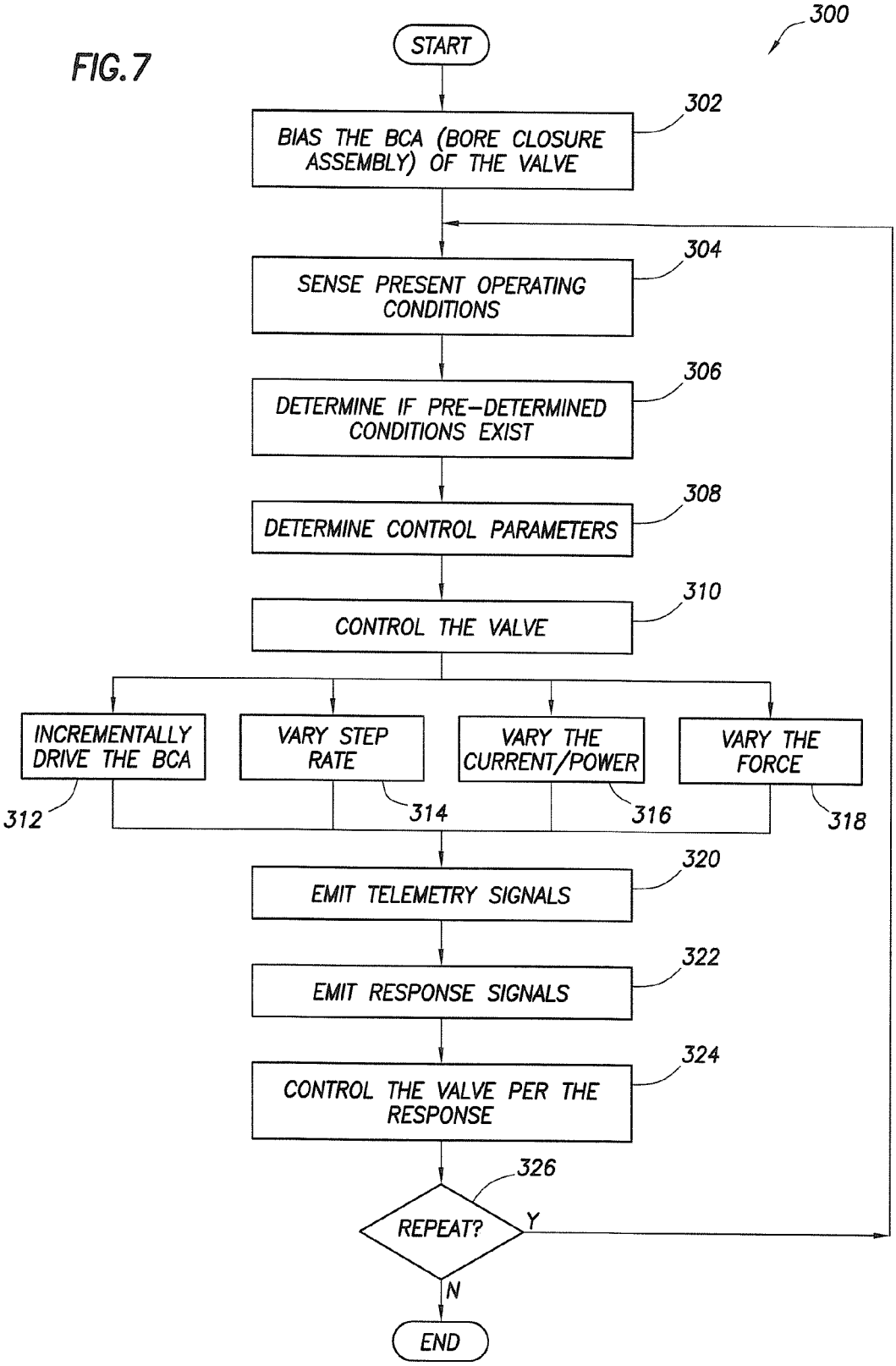
FIG. 7 is a flowchart of a method of controlling a valve in a well.

FIG. 7 is a flowchart illustrating a method of controlling a valve 10 for use in a well. The method 300 of the current embodiment includes biasing the bore closure assembly 46 of the valve 10 toward a position such as the closed position. See reference 302. At some time, the present operating conditions of the valve 10, the production string 24, and/or the production facility 18 is sensed during method 300. For instance, the downhole pressure, the downhole flow rate, the load or force being applied to the mechanical linkage 50, the position of the bore closure assembly 46, the current being sent to the stepper motor 272, the power being sent to the stepper motor 272, the resistance to the operation of the stepper motor 72, etc. can be sensed by control system 200. In addition, or in the alternative, inputs from a user and/or the production facility 18 can be received and considered during method 300. See reference 304.

As a further embodiment, in a demand control system method, the demand system includes sensors which sense the input voltage at the downhole control system and the subsea control system modulates the line voltage to ensure that the downhole control system has the proper voltage.

Method 300 also includes determining, in response to the sensed operating condition(s), whether a pre-determined set of conditions exist. For instance, it can be determined whether the present operating conditions in the production facility 18 or the production string 24 indicate that it might be desirable to close the valve 10. In the alternative, the present operating conditions might indicate that it would be desirable to vary the flow rate of hydrocarbons through the valve 10 or the pressure on the upstream side of the valve 10. See reference 306.

Should the present operating conditions indicate that changing the position of the bore closure assembly 46 might be desirable, a set of parameters associated with driving the bore closure assembly 46 to the new position can be determined. For instance, because stepper motor 272 allows the force it develops to be set (and controlled), that force can be determined at reference 308. Moreover, the step rate of the stepper motor 272 can also be determined. As a result, the valve 10 can be controlled in accordance with the determined parameters. See reference 310. More particularly, it might be desired to drive the bore closure assembly 46 toward the new position in increments. Thus, a number of steps can be selected for the stepper motor 272 to execute to drive the bore closure assembly 46 incrementally toward the new position. See reference 312.

In the alternative, or in addition, it might be desired to drive the bore closure assembly 46 at some desired velocity. If so, a step rate of the stepper motor 272 (corresponding to the desired velocity) can be determined. Furthermore, the step rate and the velocity of the bore closure assembly 46 can be varied during method 300. For instance, in an initial portion of the movement of the bore closure assembly 46, the step rate and velocity can be relatively high so that the valve 10 begins to close rapidly. Thus, if it is desired to shut-in the well, the flow of hydrocarbons from the hydrocarbon gathering zone 34 (see FIG. 1) can be slowed (and stopped) with minimal delay. Then, the step rate and the bore closure assembly velocity can be reduced in a subsequent portion of the movement. While, the step rate can be varied for a number of reasons, slowing the step rate toward the end of a movement (particularly to a fully open or fully closed position) can avoid impacting the flapper seat 68 with the flapper 52. In this manner, the bore closure assembly 46 can be closed within less than about 5 seconds (or some other time frame). Thus, reference 314 illustrates that the step rate and velocity of the bore closure assembly 46 can be varied.

At reference 316, FIG. 7 illustrates that the force applied to the mechanical linkage 50 by the stepper motor 272 can be varied. More particularly, since the force (i.e., the torque) exerted by the stepper motor 272 can be set by varying the current that drives the stepper motor 272 during its steps, that force can be controlled. Thus, during an initial portion of the movement of the ball closure assembly 46, the force applied to the mechanical linkage 46 can be set to one level. Then, during a subsequent portion of that movement, the force can be set to another level, either higher or lower. Of course, the force can be varied in other manners depending on the user's needs.

In addition, or in the alternative, the current and/or power applied to the stepper motor 272 can be varied to, for instance, control the amount of heat generated in the wire 282 and/or at other downhole locations. The current or power applied to the stepper motor 272 can be varied for other reasons including managing the amount of downhole power available for other purposes without departing from the scope of the invention. Thus, the current/power amplifier 230 can be a variable current/power source controlled by a time varying signal from the control circuit 226. See reference 318.

At pre-determined intervals, or upon the detection of one or more sets of pre-determined conditions, the control circuit 226 can emit a telemetry signal 244 to the surface controller 222. The telemetry signal(s) 244 can convey information regarding the operating conditions sensed by the pressure sensor 210, the flow rate sensor 212, the load sensing assembly 216, the position sensor 218, etc. In addition, the telemetry signal 244 can include other information such as, but not limited to, the power and current being applied to the stepper motor 272 as sensed by the current and voltage sensors 246 and 248, the state (engaged or dis-engaged) of the clutch 214, the state of the brake 202 (applied or released), whether the hold signal 240 is being detected, and other operating parameters of the valve 10 (and, more particularly, the local controller 278). See reference 320.

The surface controller 222 can receive the telemetry signals 244 and determine whether some control action might be desirable. In addition, the surface controller 222 can receive inputs from the user and the production facility 18 and, in accordance with the functions of the application 224 resident in the surface controller 222, can emit a response to the telemetry signal 244. That response can take the form of one or more control signals 242, which are sent to the local controller 278. Moreover, the response can include forwarding the information in the telemetry signal 244, or derived there from, to the production facility 18 for storage or further processing. In some embodiments, if the local controller 278 fails to receive the control signals 242 within some pre-determined time, the local controller 278 can execute instructions for, or otherwise cause to happen, some pre-determined set of control actions. Thus, the local controller 278 and the surface controller 222 can "ping" each other or execute a "handshake" protocol. See reference 322. With continuing reference to FIG. 7, method 300 of the current embodiment also includes controlling the valve 10 in accordance with the control signal 242 or lack thereof. See reference 324.

If desired, all or some of method 300 can be repeated as indicated at reference 326. Otherwise, the method 300 can be terminated.

More particularly, valves of some embodiments include electronics at (or in) the valves, either as integral components thereof or as components installed on the valves. These components include internal sensors, which the control systems use to monitor and control the valves with (or without) relying on control components on the surface. In addition, the control systems can use sensors external to the valve to do the same. Furthermore, in addition to sensors to monitor the mechanical operation of the valves, the valves include sensors to monitor the electronic components of the control systems. In some embodiments valves and/or their control systems include a plurality of sensors including, but not limited to, pressure sensors, flow rate sensors, temperature sensors, vibration sensors, electric current sensors, and voltage sensors in various combinations. As a result, embodiments provide improved control of the mechanical and electrical aspects of the valves. Improved diagnostic capabilities also flow from valves, control systems, and methods of various embodiments.

In one embodiment, an electric actuator of a valve is controlled with a stepper motor. A number of steps (or pulses of selected current and voltage levels) for the stepper motor to execute is determined based on parameters reflecting the operating conditions of the valve, the well, the associated production facility, etc. In the alternative, or in addition, the valve can include a DC (Direct Current) motor to which power is supplied at a selected current and voltage. For instance, the valve may include a motor such as of the types previously described herein. Regardless of the type of motor included in the valve, the control system controls the motor to drive the valve with a stable output force based on the motor torque, gearing, drive mechanisms (for instance a ball screw), etc. In some situations, the control system varies the output force based on measurements of the performance of the valve (and the control system as well). For instance, the current supplied to the motor can be increased or decreased to vary the motor's torque and, hence, the force output by the actuator. In some embodiments, the measurements and resulting control actions occur either continuously, intermittently, or periodically. These measurements and control actions can occur at or near pre-selected locations of the travel of the valve (i.e., the travel of the actuator or mechanical linkage of the valve). In addition, or in the alternative, the control system can allow a user to control the operation of the valve.

Valves, including stepper motors can be controlled using a stable or consistent sequence of steps (or electric pulses). For instance, the steps can be increased or decreased in a stepped or ladder pattern or they can be ramped up or down at selected rates. One benefit arising from such operational scenarios includes running the motor with less power when resistance to driving the valve is low and running it with more power when that resistance is high.

Embodiments also make use of a characteristic of most stepper motors in that stepper motors provide more torque at slower speeds than at higher speeds. Operation of valves of these embodiments can be optimized with respect to their actuation times (in either the opening or closing directions or both) by adjusting the motor speeds with stepped or ramped patterns. Thus, the speeds and torques of the stepper motors can be optimized to allow the motor outputs to be synchronized with the load on the motors developed as a result of driving the valves. In some embodiments, these output forces are kept high at selected margins above the valve loads. Moreover, the control systems can vary those margins based on operating conditions or on other inputs.

Other features of the valves of various embodiments relate to power consumption. For instance, with conventional valves, power is supplied from the surface to the valves at constant levels. As a result, various uphole and downhole components must be oversized to handle excess power even during those times when lower power levels are drawn by the valves. In contrast, control systems of embodiments monitor the power usage of the valves with downhole electronics, logic, circuitry, etc. and adjust the power delivered to the valves based on present operating conditions (such as the power being demanded by the valves). These control systems, therefore, deliver varying amounts of power to the downhole electronics associated with valves of these embodiments. As a result, the control systems deliver only the power needed by the valves for their operation thereby allowing the uphole and downhole components to be optimized to accurately control power consumption and the attendant heat generation.

Furthermore, valves of various embodiments include logic to perform the functions disclosed herein and to provide telemetry signals conveying information regarding the valves to uphole electronics associated with these valves. The uphole electronics can respond to the telemetry signals within a selected time frame (that is, the uphole electronics can "ping" or perform "handshakes" with the valves). When the valves fail to receive the response signal within an appropriate time, the downhole electronics of the valves can execute a set of commands accordingly. For instance, the downhole electronics could close the valves or allow the valves to close when they are so biased (even in the absence of power). However, other commands, diagnostic activities, etc. could be executed by the downhole electronics.

Thus, valves of embodiments can be optimized for the application to which they are applied. Indeed, the operation of these valves can be re-configured in the field by changing the corresponding control schemes. In addition, valves of various embodiments operate more efficiently with greater reliability, possess longer useful lifetimes, and are less expensive to operate than heretofore possible.

Although the subject matter has been described in language specific to structural features and/or methodological acts, it is to be understood that the subject matter defined in the appended claims is not necessarily limited to the specific features or acts described above. Rather, the specific features and acts described above are disclosed as illustrative forms of implementing the claims.

The invention claimed is:

1. A surface controlled subsurface control valve for operating in a wellbore extending through a subterranean formation, the valve comprising:

a valve body defining a bore for fluid to flow through;

a bore closure assembly movable between an open position in which the bore closure assembly allows fluid flow through the bore and a closed position in which the bore closure assembly prevents fluid flow through the bore;

a mechanical linkage operatively coupled to the bore closure assembly;

a rotary motor operatively coupled to the mechanical linkage; and a primary control assembly configured to vary the force applied to the bore closure assembly by the rotary motor, such that:

during a first portion of movement of the bore closure assembly in a first direction, the rotary motor applies a first amount of force to the bore closure assembly, the first amount of force based on a first present operating condition; and during a subsequent portion of movement of the bore closure assembly in the first direction, the rotary motor applies a second amount of force to the closure assembly, the second amount of force different than the first amount of force and applied by the rotary motor in the same direction as the first force and during movement of the bore closure assembly in the first direction, the second amount of force based on a second present operating condition.

2. The valve of claim 1, wherein at least one of the first or second present operating condition is at least one of a present bore closure assembly position between the open and closed positions, a present bore closure assembly position at the open or closed position, a fluid flow rate of fluid in the wellbore or valve, a wellbore or valve temperature, a fluid pressure in the wellbore or valve, a load on the rotary motor, a load on the mechanical linkage, a drive force exerted on the mechanical linkage, a drive force exerted on the bore closure assembly, a torque on the rotary motor, a speed of the rotary motor, a speed of the linkage assembly, a speed of the bore closure assembly, and a measured electrical load, current, resistance, or power associated with the rotary motor.

3. The valve of claim 1, wherein the bore closure assembly is selectively movable to incremental positions between the open and closed positions.

4. The valve of claim 1, wherein the second amount of force is greater than the first amount of force.

5. The valve of claim 1 further comprising a first and second sensing assembly operatively connected to the control assembly, the first and second sensing assembly for sensing the first and second present operating conditions.

6. The valve of claim 5, wherein the rotary motor is a component of a drive assembly, and wherein the second sensing assembly comprises a load sensing assembly operatively connected to the drive assembly to sense a load on the drive assembly.

7. The valve of claim 6, wherein the control assembly, in response to signals from at least one sensing assembly, varies the force applied to the mechanical linkage during movement of the mechanical linkage.

8. The valve of claim 7, wherein the rotary motor is electrically powered and wherein the primary control assembly varies the electrical power to the rotary motor.

9. The valve of claim 5, wherein the rotary motor is a stepper motor.

10. The valve of claim 9, wherein the stepper motor is operable to run at various step-rates and wherein the primary control assembly controls the step-rate of the stepper motor and varies the step-rate of the stepper motor in response to signals from at least one of the sensing assemblies.

11. The valve of claim 10, wherein one of the first and the second sensing assemblies comprise a resistance sensing assembly operatively connected to the stepper motor to sense the resistance to operation of the stepper motor.

12. The valve of claim 11, wherein the primary control assembly controls electric power to the stepper motor and wherein the primary control assembly varies the electric power to the stepper motor in response to the resistance sensing assembly.

13. The valve of claim 5, wherein the first or second sensing assemblies is for sensing a parameter of fluid flow rate, temperature, or pressure, each sensing assembly operatively connected to the primary control assembly.

14. The valve of claim 5, wherein the first sensing assembly comprises a plurality of sensors, each sensor operatively connected to the primary control assembly.

15. The valve of claim 5, wherein the second sensing assembly measures a fluid flow rate and wherein the control assembly, in response to the measured flow rate, varies the force applied to the bore closure assembly.

16. The valve of claim 1 further comprising a surface control assembly for controlling the valve, the primary control assembly communicating a first signal to the surface control assembly, the surface control assembly providing a response signal in response to the signal from the control assembly.

17. The valve of claim 16, wherein the primary control assembly emits a second signal to the surface control assembly upon a predetermined set of operating conditions, and wherein the surface control assembly emits control signals to control operation of the valve in response to the signals from the control assembly.

18. The valve of claim 16, wherein the primary control assembly emits further signals to the surface control assembly at predetermined time intervals, and wherein the surface control assembly emits control signals to control operation of the valve in response to the signals from the control assembly.

19. The valve of claim 1, wherein the primary control assembly is further configured to vary at least one of the rate of travel of a present bore closure assembly position, a fluid flow rate of fluid in the wellbore or valve, a wellbore or valve temperature, a fluid pressure in the wellbore or valve, a load on the rotary motor, a load on the mechanical linkage, a drive force exerted on the mechanical linkage, a drive force exerted on the bore closure assembly, a torque on the rotary motor, a speed of the rotary motor, a step rate of the rotary motor, a speed of the linkage assembly, a speed of the bore closure assembly, and a measured electrical load, current, resistance, or power associated with the rotary motor.

20. The valve of claim 1, wherein the primary control assembly is further configured to vary the speed of the bore closure assembly when the valve is proximate a fully closed or a fully open position.

21. The valve of claim 1, wherein the motor speed or torque is optimized such that rotary motor outputs are synchronized with load on the rotary motor.

22. The valve of claim 1, wherein the rotary motor is bi-directional.

23. A method of controlling a surface controlled subsurface control valve for use in a subterranean well, the method comprising:

sensing a first present operating condition of the valve, the valve including:

a valve body defining a bore for fluid to flow through, a bore closure assembly movable between an open position in which the bore closure assembly allows fluid flow through the bore and a closed position in which the bore closure assembly prevents fluid flow through the bore, and a rotary motor operatively coupled to the bore closure assembly to drive the bore closure assembly;

applying a first force to the bore closure assembly by the rotary motor based on the first sensed operating condition;

moving the bore closure assembly in a first direction in response to the applied first force;

sensing a second present operating condition of the valve; and varying the force applied to the bore assembly by the rotary motor based on the second present operating condition.

* * * * *